United States Patent [19]

Carter et al.

[11] Patent Number: 5,017,116

[45] Date of Patent: May 21, 1991

[54] SPINNING PACK FOR WET SPINNING BICOMPONENT FILAMENTS

[75] Inventors: Don E. Carter, St. Louis, Mo.; Arnold L. McPeters, Raleigh; Hobson L. Skeen, High Point, both of N.C.

[73] Assignee: Monsanto Company, St. Louis, Mo.

[21] Appl. No.: 442,499

[22] Filed: Nov. 27, 1989

Related U.S. Application Data

[63] Continuation of Ser. No. 291,891, Dec. 29, 1988, abandoned.

[51] Int. Cl.[5] ..... B29C 47/30

[52] U.S. Cl. ..... 425/131.5; 264/171; 425/192.5; 425/382.2; 425/463; 425/DIG. 217

[58] Field of Search ..... 425/131.5, 131.1, 191.1, 425/192, 192.5, 382.2, 463, DIG. 217; 264/171

[56] References Cited

U.S. PATENT DOCUMENTS

| | | | |
|---|---|---|---|
| 3,176,345 | 4/1965 | Powell | 425/131.5 |
| 3,182,106 | 5/1965 | Fujita et al. | 425/131.5 |
| 3,192,562 | 7/1965 | Powell | 425/192.1 |
| 3,403,422 | 10/1968 | Nakagawa et al. | 425/131.5 |
| 3,406,427 | 10/1968 | Tsuji | 425/382.2 |
| 3,492,692 | 2/1970 | Soda et al. | 425/131.5 |
| 3,540,077 | 11/1970 | Nakagawa et al. | 425/131.5 |
| 3,792,944 | 2/1974 | Chimura et al. | 425/131.5 |
| 4,738,607 | 4/1988 | Nakajima et al. | 425/131.5 |

FOREIGN PATENT DOCUMENTS

| | | | |
|---|---|---|---|
| 41-17927 | 10/1966 | Japan | 425/131.5 |
| 42-18562 | 2/1967 | Japan | 425/131.5 |
| 47-38884 | 10/1972 | Japan | 425/131.5 |

*Primary Examiner*—Jay H. Woo
*Assistant Examiner*—Khanh P. Nguyen
*Attorney, Agent, or Firm*—John W. Whisler

[57] ABSTRACT

A spinning pack for wet spinning a tow having at least 20,000 bicomponent acrylic filaments is described. The pack includes a plurality of specially designed plates arranged so as to provide filaments having a substantially uniform distribution of the components along the entire length of each filament and from filament to filament.

4 Claims, 1 Drawing Sheet

SPINNING PACK FOR WET SPINNING BICOMPONENT FILAMENTS

This is a continuation of application Ser. No. 291,891, filed Dec. 29, 1988 now abandoned.

BACKGROUND OF THE INVENTION

This invention relates to a spinning pack for wet spinning a large number of bicomponent filaments, particularly, bicomponent acrylic filaments and, more particularly, bicomponent acrylic filaments having the specific ability to develop a helical crimp on hot or hot/wet treatment because of a difference in shrinkage between the two components. (Bicomponent filaments having this ability are commonly referred to as "conjugate filaments".) The term "bicomponent filaments", as used herein, means filaments consisting of two components arranged either in a side-by-side or sheath/core configuration along the length of the filaments. The term "wet spinning" as used herein means a process in which a solution of fiber-forming polymer is extruded from a spinning pack through orifices directly into a liquid coagulation medium where the polymer is coagulated to form filaments that are further processed. Preferably, the spinning pack is immersed in the liquid coagulation medium. However, if desired, the spinneret may be placed a short distance (e.g. 0.5 to 2 cm) above the surface of the liquid medium.

Spinning packs useful for wet spinning bicomponent filaments are described in the prior art, for example, U.S. Pat. No. 3,176,345 describes a spinning pack consisting of stacked plates that are bolted together. Some of the plates have slots defining orifices and the remaining plates have hollow regions defining manifolds. The plates are arranged so that a slotted plate is sandwiched between two manifold plates. In operation of the pack two solutions under pressure are fed to the pack, one polymer spinning solution flows to the manifold plates on one side of the slotted plates and the other polymer solution flows to the manifold plates on the other side of the slotted plates. The two solutions combine in each of the slots of the slotted plates and are extruded from each slot as a single stream which, when coagulated, provides a bicomponent filament. One problem encountered in using this pack is that the distribution of the two components in the filaments is not uniform because the lower viscosity solution tends to wrap around the higher viscosity solution.

SUMMARY OF THE INVENTION

The present invention provides a spinning pack useful for wet spinning bicomponent filaments. The pack is characterized in being capable of providing a large number of conjugate filaments having a substantially uniform distribution of the components along the entire length of each filament and from filament to filament. The pack comprises a plurality of assembled metal plates which define openings through which two spinning dopes flow enroute to a spinneret. The pack of the present invention is particularly useful for wet spinning a tow consisting of in excess of 20,000 conjugate acrylic filaments. The tow can then be processed into yarn useful for applications where high bulk is desirable, for example, craft yarns and sweater yarns.

DETAILED DESCRIPTION OF THE PREFERRED EMBODIMENTS

Spinning packs of the invention comprise individual thin metal plates. Typically, there are four different types of thin plates plus two end plates and a spinneret plate. The packs are provided by first making the required number of each type of plate, preferably, from stainless steel. These plates can be made, for example, by machining stacks of solid plates by the technique of electron discharge machining (sometimes referred to as wire cutting) or by photoetching. The plates are then assembled in the proper order and converted by appropriate means to a structure that does not leak under conditions normally encountered in wet spinning processes. Preferably, the structure is converted to a monolithic structure by utilizing the process generally known as diffusion bonding (sometimes referred to as isostatic pressing). In diffusion bonding the assembled plates are cleaned and held together in an inert atmosphere or under vacuum while being heated under conditions sufficient to cause the atoms of the adjacent metal plates to diffuse rapidly between the plates and convert the assembled plates to a monolithic structure. For example, diffusion bonding of stainless steel plates is accomplished by holding the plates by pressures in the range of 50 to 2000 psig while heating the plates at a temperature in the range of 1700° to 1900° F. for a period ranging from ½ hour to 24 hours. It is contemplated that the plates, instead of being made from stainless steel, may be made from other metals or from materials such as ceramics or carbon.

Figure 1:
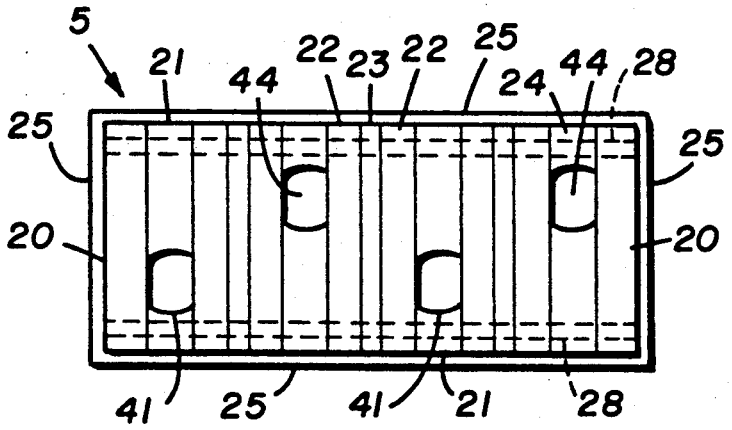
FIG. 1 is a top view of a preferred spin pack of the invention.
Figure 4:
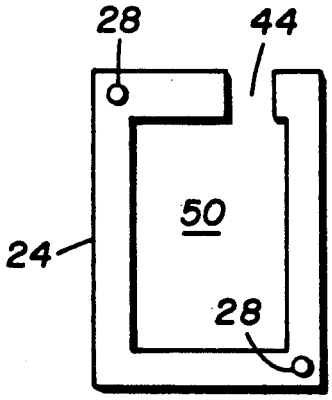
FIG. 4 is a right side elevation of plate 24 shown in FIG. 2.
Figure 2:
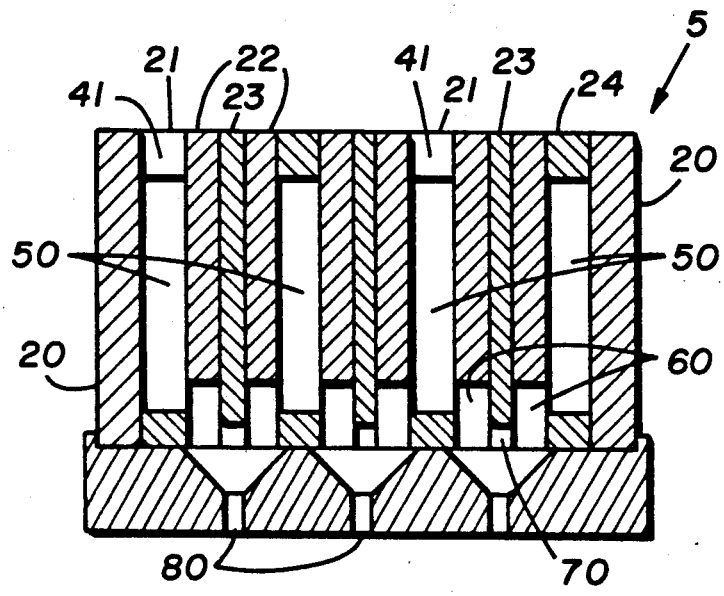
FIG. 2 is a front elevation of the spin pack shown in FIG. 1.
Figure 5:
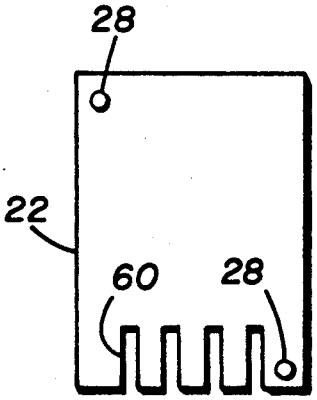
FIG. 5 is a right side elevation of plate 22 shown in FIG. 2.
Figure 3:
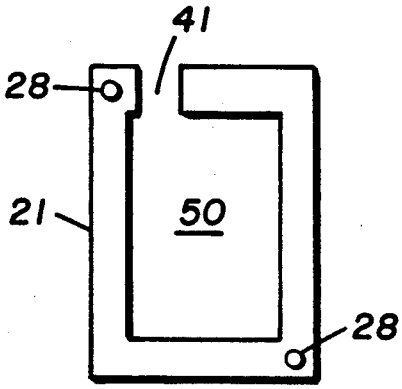
FIG. 3 is a right side elevation of plate 21 shown in FIG. 1.
Figure 6:
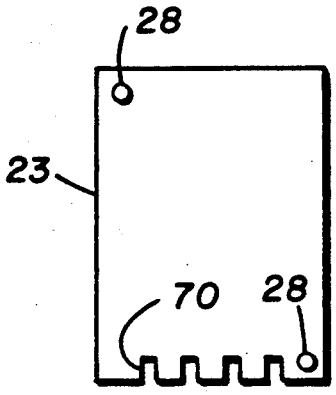
FIG. 6 is a right side elevation of plate 23 shown in FIG. 2.

A preferred spinning pack of the invention and its component parts are shown in the accompanying Figures. Referring to FIG. 2, spinning pack 5 consists of end walls or plates 20, spacer plates 21 and 24, capillary plates 22, divider plates 23 and spinneret plate 25 arranged as shown in FIG. 2. As shown in FIGS. 3 and 4, each of the spacer plates 21 and 24 has inlets 41 and 44, respectively, leading to central cavity 50. As shown in FIG. 5, each of the capillary plates 22 has rectangular slots 60 extending inwardly and perpendicularly from the lower edge thereof a selected distance. As shown in FIG. 6, each of the divider plates 23 has rectangular slots 70 extending inwardly and perpendicularly from the lower edge thereof. Slots 60 are of the same width as slots 70 but are longer. When plates 22 and 23 are arranged as shown in FIG. 2, slots 70 are aligned with slots 60. Spacer plates 21 differ from spacer plates 24 in that inlet 41 of plates 21 is reversed from inlet 44 of plates 24 as shown in FIG. 1. Spinneret plate 25 has orifices 80 and facilitates formation of uniform filaments. Spinneret plate 25 may be attached to the other plates by any suitable means. According to a preferred embodiment of the invention spinneret plate 25 is compression fitted (stretched) over the other plates. According to this embodiment, plates 20–24 are constructed and arranged so as to define a curved (convex) lower surface over which spinneret plate 25 is stretched. Stretching of spinneret plate 25 over plates 20–24 may be accomplished by suitable mechanical means, such as clamps, which pull spinneret plate 25 over the other plates. The convex surface defined by plates 20–24 conforms to and fits snugly against the upper surface of spinneret plate 25. (If the lower surface formed by plates 20–24 were flat instead of convex, spinneret plate 25 tends to bulge away and separate from the other during use of the pack.) Slots 70 of plates 23 align with orifices 80 of spinneret plate 25 and compensate for any misalignment of slots 60 and orifices 80. If desired, however, slots 70 may be omitted (i.e. plates 23 may be solid).

According to another embodiment of the invention, spinneret plate 25 is omitted from pack 5, plates 23 have slots 70 and the lower surface of the pack defined by plates 20–24 is flat. (In this instance, if plates 23 were solid, each pair of opposite slots 60 abutting plates 23 would form two monocomponent fibers instead of one bicomponent fiber.)

Referring to FIGS. 1 and 2, in operation of pack 5, utilizing spinneret plate 25 and slots 70, two polymer solutions (i.e. dopes) are individually and separately fed under pressure by means of manifolds (not shown) to openings 41 and 44, one solution to openings 41 and the other solution to openings 44. The solutions flow from openings 41 and 44 into cavities 50. From cavities 50 the solution flow through slots 60 and combine or join in slots 70. The combined solutions flow through slots 70 and are extruded as streams from spinneret plate orifices 80. Slots 60 and 70 and orifices 80 are carefully sized so that the pressure drop of each spin dope when flowing through orifices 80 at the desired rate is, preferably, in the range of 20 to 200 psig. This permits each orifice 80 to deliver an accurately controlled flow of dope to its outlet. The solutions are emitted from orifices 80 in the form of streams which, when coagulated, provide bicomponent filaments in which the components are arranged in either a side-by-side or sheath/core configuration along the longitudinal axis of the filaments, depending on the viscosities of the two spinning solutions. In general, when the solutions are of the same viscosity, the components will be arranged in a side-by-side configuration, whereas if solutions are each of a different viscosity, the components will be arranged in or approximate a sheath/core configuration since the lower viscosity solution tends to wrap around the higher viscosity solution. According to one embodiment of spinning pack 5 improved distribution of flow is achieved by sizing the thickness and width of slots 60 so that those through which one of the two spinning dopes flows enroute to orifices 80 are of a lesser cross-sectional area than those through which the other spinning dope flows. According to another embodiment of the invention, formation of sheath/core fibers is facilitated by placing tubes between each opening defined by slots 60 and 70 and each spinneret plate orifice 80. The tubes are, for example, 2.54 cm long and sealably connected to each said opening and its corresponding orifice 80.

During operation of pack 5, the dopes are considerably hotter (30° to 60° C.) than the aqueous coagulating liquid. It is important that dope in cavities 50 located at the outer portion of the pack is not cooled by the aqueous coagulating liquid to a greater extent than is dope in cavities 50 located at the center of the pack. Lowering the temperature of the dope, increases its viscosity, lowers its flow rate through the pack and, consequently, causes smaller diameter fibers to be formed. To prevent this, it is a conventional practice to heat packs, for example, by jacketing the pack and circulating a heating fluid (e.g. steam or oil) in the jacket or by providing channels in the plates for circulating a heated fluid.

For purposes of providing conjugate type filaments having the ability to develop the highest possible level of bulk, the components are arranged in a side-by-side configuration where the distribution of the components is in a ratio of 1:1, that is in cross-section one half of the filament consist entirely of one of the components and the other half consists entirely of the other component. The distribution of the components in the filaments can be selected by selecting the appropriate rates at which the solutions are fed to the orifices, for example, if one of the solutions is fed to the orifices at twice the rate of the other solution, the distribution of the two components in the filament will be in a ratio of 1:2, assuming Newtonium flow and other conditions remained the same. The distribution of the components in each filament and from filament to filament is maintained substantially the same by means of divider plates 23.

The packs of the invention are particularly useful for providing a tow consisting of at least 20,000 conjugate acrylic filaments in which the distribution of the components is 1:1. Since the size of each of the filaments formed by the pack will be determined by the cross-sectional area of orifices 80, plates 22 and 23 must be thin and the slots narrow in order to provide packs capable of spinning 20,000 plus filaments. Suitable plates for preparing such a pack would be, for example, divider plates 23 each having a thickness of 3 mils, capillary plates 22 each having a thickness of 6 mils and spacer plates 21 and 24 each having a thickness of 31 mils. (A typical spinneret plate 25 has a thickness of 0.152 cm and each orifice 80 a diameter of 0.009 cm.) Slots 60 and 70 are preferably provided in plates 22 and 23 by means of electron discharge machining techniques. The plates are assembled in the order shown in FIG. 2. This order of assembly is continued until a pack with the desired number of orifices is achieved. The plates are held in alignment by means of dowel rods 28 during assembly and bonding of the plates. The assembled pack is then preferably subjected to appropriate diffusion bonding conditions to provide a monolithic structure.

The following example is given to further illustrate the invention. In the example percentages are weight percentages.

EXAMPLE

This example illustrates wet spinning conjugate acrylic filaments using the pack of the present invention.

A first spinning solution is prepared by dissolving an appropriate amount of an acrylic polymer containing 92.5% of acrylonitrile (AN) and 7.5% vinyl acetate (VA) in dimethylacetamide (DMAc) to provide a solution containing 25% of the polymer. A second spinning solution of about the same viscosity is prepared in the same way, except in this instance the acrylic polymer contains 92.1% AN, 7.3% VA and 0.6% sodium p-sulfophenylmethallyl ether (SPME). For spinning, a pack shown in the accompanying Figures and having 30,000 orifices is used. The pack is immersed in a coagulation bath consisting of a 55% aqueous solution of DMAc at a temperature of 45° C. The first solution at 100° C. is fed into the pack through inlets 41 (FIG. 1) and the second spinning solution at 100° C. is fed into the pack through inlets 44 (FIG. 1). The resulting tow consisting of 30,000 bicomponent filaments in which the components are arranged in a side-by-side configuration is withdrawn from the coagulation bath at a linear speed of 20 fpm (6.1 mpm) with a theoretical jet stretch of 0.9 times by a first set of rolls, washed on these rolls, then stretched 6 times in boiling water between the first set of rolls and a second set of rolls, washed on the second set of rolls, dried on drying rolls and collected on a winder bobbin at a speed of 120 fpm (36.6 m). The tow is then crimped and annealed with steam under conditions that do not develop the latent helical crimp present in the conjugate filaments of the tow. The tow is then converted to staple and made into skeins of yarn. The yarn is then wet-dyed and dried under conditions that develop the latent helical crimp. The resulting yarns have excellent bulk when observed under a microscope, the distribution of the tow components is substantially uniform along the length of each filament and from filament to filament and there is no visual evidence of splitting of the components.

In related experiments bicomponent filaments in which the components are arranged in a sheath/core configuration are made by utilizing the above dopes except in this instance the dopes are prepared so that the dope containing SPME is of a lesser viscosity (e.g. 1/6th) than the other dope. Similar results are obtained.

We claim:

1. A rectangular spinning pack for wet spinning bicomponent acrylic filaments comprising thin metal rectangular plates arranged side by side, said plates comprising:

a. a pair of end plates b. a plurality of first and second spacer plates, each having a central cavity and an opening in the top edge thereof leading to said central cavity, said central cavity being a distance X from the bottom edge thereof;

c. a plurality of capillary plates, each having a plurality of slots extending inwardly from the bottom edge thereof a distance greater than said distance X; and d. a plurality of divider plates, each having slots corresponding in number and shape to the slots of said first and second capillary plates except that the slots extend inwardly from the bottom edge thereof a distance less than said distance X;

said spacer, capillary and divider plates being arranged between said pair of end plates such that the order thereof is first spacer plate, capillary plate, divider plate, capillary plate and second spacer plate, whereby said slots in said capillary and divider plates define orifices, means for forcing a first acrylic polymer solution through said orifices via said openings and said cavities in said first spacer plates and means for forcing a second acrylic polymer solution through said orifices via said openings and said cavities in said second spacer plates.

2. The pack of claim 1 fitted with a spinneret plate having an orifice inline with each slot of each divider plate.

3. The pack of claim 2 wherein said plates are made of stainless steel.

4. The pack of claim 3 wherein said pack has at least 20,000 orifices.

* * * * *